US010932054B2

(12) United States Patent
Zhou et al.

(10) Patent No.: US 10,932,054 B2
(45) Date of Patent: Feb. 23, 2021

(54) SOUND DEVICE

(71) Applicant: AAC ACOUSTIC TECHNOLOGIES (SHENZHEN) CO., LTD., Shenzhen (CN)

(72) Inventors: Jiasheng Zhou, Shenzhen (CN); Long Zhang, Shenzhen (CN)

(73) Assignee: AAC Acoustic Technologies (Shenzhen) Co., Ltd., Shenzhen (CN)

( * ) Notice: Subject to any disclaimer, the term of this patent is extended or adjusted under 35 U.S.C. 154(b) by 0 days.

(21) Appl. No.: 16/524,180

(22) Filed: Jul. 29, 2019

(65) Prior Publication Data

US 2020/0045458 A1 Feb. 6, 2020

(30) Foreign Application Priority Data

Aug. 1, 2018 (CN) ..... 201821237983.0

(51) Int. Cl.

| | |
|---|---|
| ***H04R 9/06*** | (2006.01) |
| ***H04R 9/02*** | (2006.01) |
| ***H04R 7/12*** | (2006.01) |
| ***H04R 31/00*** | (2006.01) |
| ***H04R 7/16*** | (2006.01) |
| ***H04R 7/18*** | (2006.01) |

(52) U.S. Cl.

CPC ..... *H04R 9/06* (2013.01); *H04R 7/127* (2013.01); *H04R 7/18* (2013.01); *H04R 9/025* (2013.01); *H04R 31/003* (2013.01); *H04R 2307/025* (2013.01); *H04R 2400/11* (2013.01)

(58) Field of Classification Search

CPC . H04R 9/06; H04R 9/02; H04R 9/025; H04R 7/16; H04R 1/2811; H04R 1/2846; H04R 1/2823

See application file for complete search history.

(56) References Cited

U.S. PATENT DOCUMENTS

| | | | | |
|---|---|---|---|---|
| 6,568,503 B2 * | 5/2003 | Proni | ..... | H04R 7/20 181/171 |
| 2014/0241566 A1 * | 8/2014 | Choi | ..... | H04R 9/043 381/400 |
| 2018/0077495 A1 * | 3/2018 | Liu | ..... | H04R 7/16 |

* cited by examiner

*Primary Examiner* — Sunita Joshi
(74) *Attorney, Agent, or Firm* — W&G Law Group LLP

(57) ABSTRACT

The present disclosure provides a sound device which includes a vibration system, a magnetic circuit system, and a basket that accommodates the vibration system and the magnetic circuit system. The vibration system includes a diaphragm and a voice coil that drives the diaphragm to vibrate. The fixing portion includes a first fixing portion fixed to the upper surface and extending to an edge of the upper surface and a second fixing portion extending from the first fixing portion and along the outer side surface. The second fixing portion in a continuous ring shape is around an end of the outer side surface close to the upper surface in a sealing manner, and a thickness of the second fixing portion is increasing in a direction away from the upper surface.

9 Claims, 2 Drawing Sheets

SOUND DEVICE

TECHNICAL FIELD

The present disclosure relates to acoustoelectric technology, and particularly relates to a sound device with an improved diaphragm.

BACKGROUND

With a rapid development of an electronic information industry, a trend of miniaturization of electronic products is becoming increasingly obvious, and sound devices applied thereto will inevitably become more and more miniaturized.

In a related technology, a sound device includes a magnetic circuit system, a vibration system, and an auxiliary system that accommodates the magnetic circuit system and the vibration system. The auxiliary system includes a front cover. The vibration system includes a diaphragm which is a conventional structure that includes a dome, a folded ring extending from the dome, and a fixing portion connected to the folded ring. The auxiliary system includes a basket. The diaphragm is sandwiched between the front cover and the basket. The above-described structure with the front cover wastes space in a thickness direction when the structure is waterproofed through sealing the front cover, the diaphragm and the basket by doubled-sided adhesive. Besides, a sound device with the above-described structure cannot satisfy a requirement for a higher level of water proof, and an adhesive force between the front cover and the diaphragm or between the diaphragm and the basket may be insufficient, resulting in failure such as water leakage, thereby reducing stability of the entire structure of a product and even affecting acoustical performance of the product.

Therefore, it is necessary to provide a sound device with a new structure.

DETAILED DESCRIPTION

The present disclosure will be further described in detail below in embodiments with reference to accompanying drawings in order to provide a better understanding of technical solutions of the present disclosure and advantages thereof. In the following embodiments, the left-right direction of the sheet of the drawings is the horizontal direction, and the up-down direction of the sheet of the drawings is the vertical direction. Further, the following specific embodiments are provided to facilitate a clearer understanding of contents of the present disclosure rather than limit the present disclosure.

Figure 1:
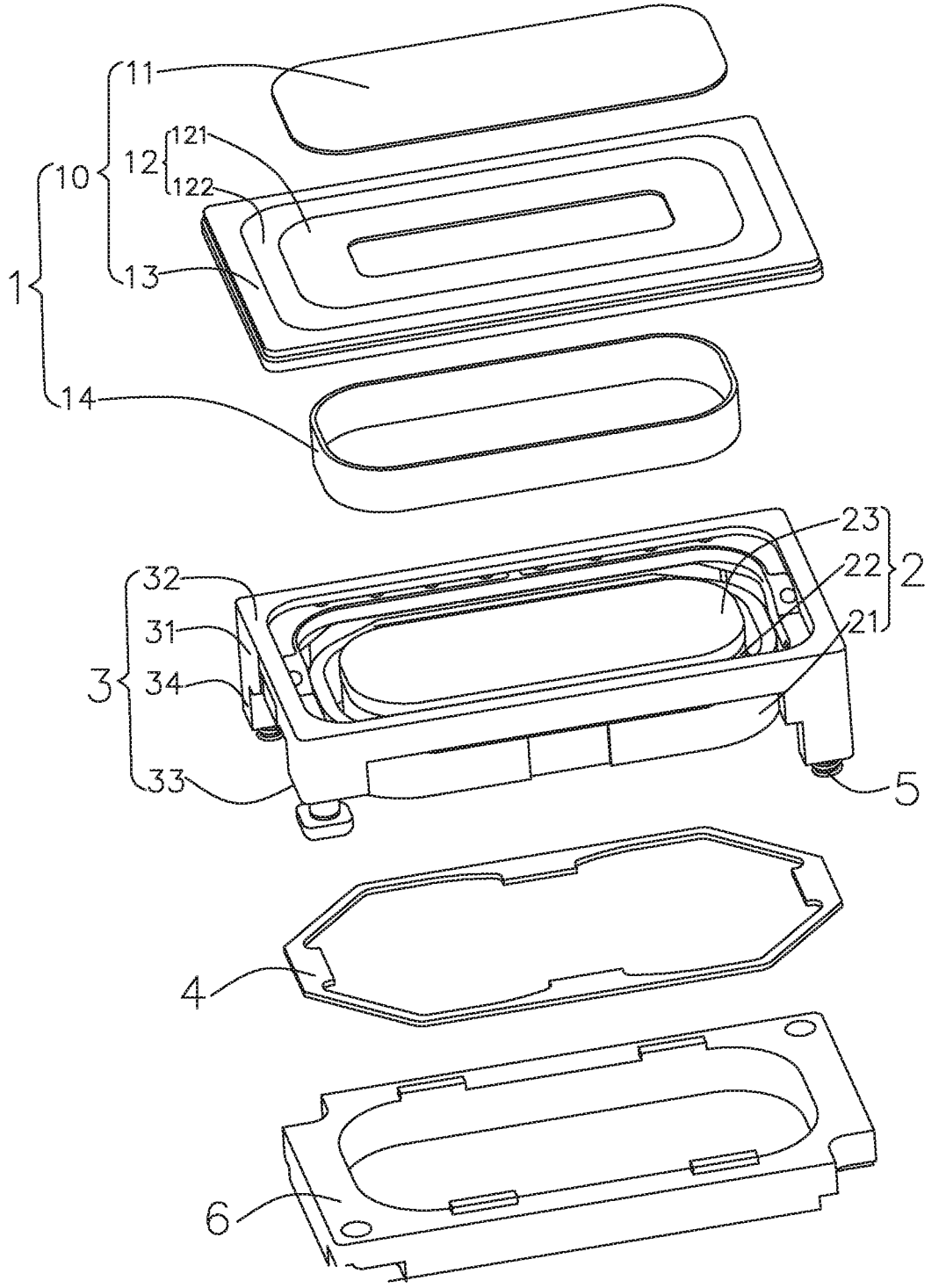
FIG. 1 is a schematic exploded perspective view of a sound device in the present disclosure.
Figure 2:
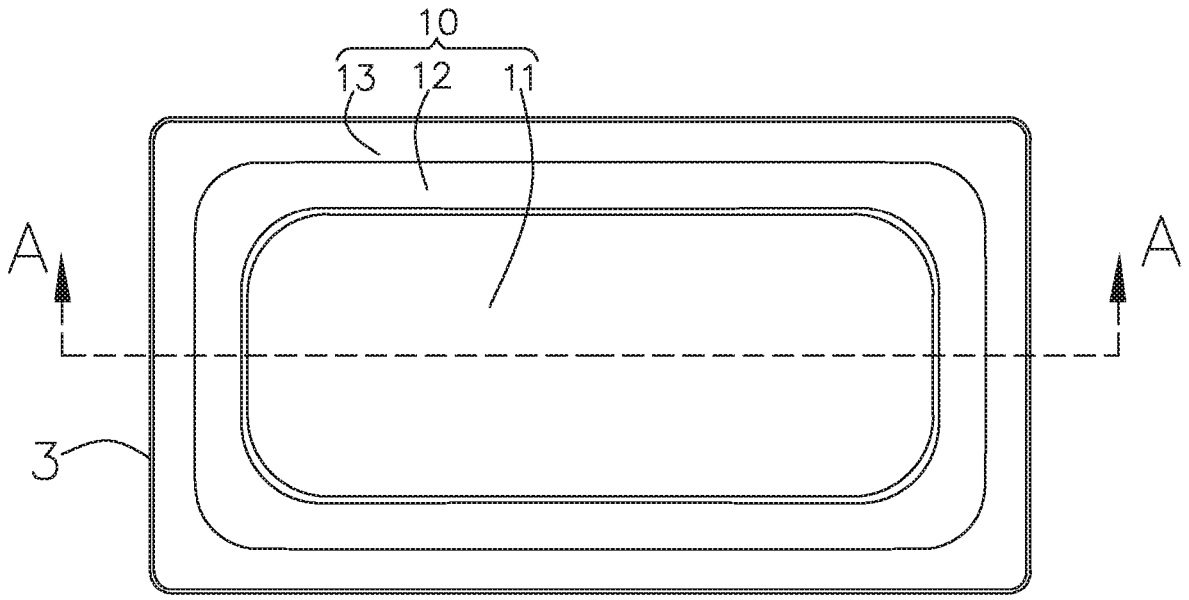
FIG. 2 is a schematic plane view of the sound device of the present disclosure.

As shown in FIG. 1 and FIG. 2, the present disclosure provides a sound device which includes a vibration system 1, a magnetic circuit system 2, and a basket 3 that accommodates the vibration system 1 and the magnetic circuit system 2. The vibration system 1 includes a diaphragm 10 fixed to the basket 3 and a voice coil 14 that drives the diaphragm 10 to vibrate and emit sound.

Figure 3:
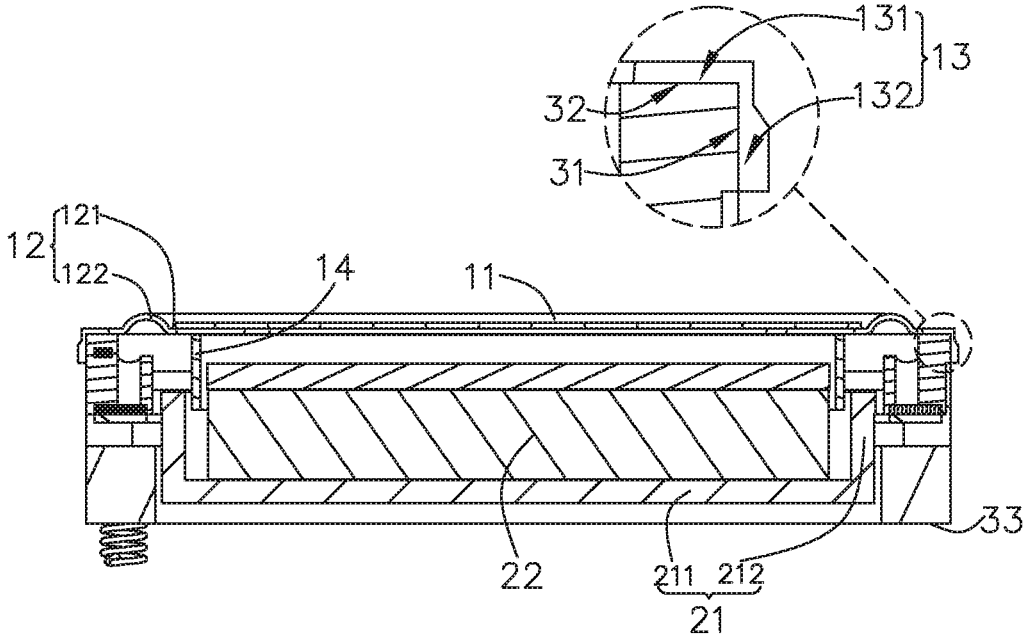
FIG. 3 is a schematic sectional view along an A-A line shown in FIG. 2.

In this embodiment, as shown in FIG. 3, the diaphragm 10 includes a dome 11, a folded ring 12 surrounding the dome 11 and a fixing portion 13 extending from an edge of the folded ring 12 and fixed to the basket 3. The folded ring 12 further includes a joint portion 121 joining the dome 11 and a protrusion 122 extending from the joint portion 121. An end of the protrusion 122 away from the joint portion 121 is connected to the fixing portion 13, and the protrusion 122 protrudes in a direction away from the voice coil 14. The joint portion 121 is provided with a through hole, and the dome 11 covers the through hole and extends to an end of the joint portion 121 close to the protrusion 122. The basket 3 is in a rectangular ring shape. The basket 3 includes an upper surface 32 opposite to the dome 11, a lower surface 33 opposite to the upper surface 32, and an outer side surface 31 connecting the upper surface 32 and the lower surface 33. The fixing portion 13 includes a first fixing portion 131 fixed to the upper surface 32 and extending to an edge of the upper surface and a second fixing portion 132 extending from the first fixing portion 131 and along the outer side surface 31. The second fixing portion 132 in a continuous ring shape is around an end of the outer side surface 31 of the basket 3 close to the upper surface 32 in a sealing manner. A thickness of the second fixing portion 132 is increasing in a direction away from the upper surface 32.

Further, the diaphragm 10 is in an axisymmetric shape with a rectangular cross section. The diaphragm 10 and the basket 3 are integrally injection-molded. The diaphragm 10 is preferably a silica gel membrane, but the present disclosure is not limited thereto. The diaphragm 10 may otherwise be a rubber membrane, a PEEK (poly-ether-ether-ketone) membrane, or a TPU (thermoplastic polyurethanes) membrane, or the like. The fixing portion 13 of the diaphragm 10 is fixed to the outer side surface 31 and the upper surface 32 of the basket 3 through adhesive. The diaphragm 10 with the above-described structure is fixed with the basket 3 in two directions. In other words, the diaphragm in a cap shape or in a cover shape is fixed to the basket 3 in a sealing manner, and the diaphragm 10 and the basket 3 are tightly compacted and sealed in two directions, thereby forming a sealing ring around the outer side surface 31 of the basket 3 and thus improving sealing performance and waterproofness of a product.

It should be noted that there is no special limitation to a dimension (such as length, width, thickness and shape) of the fixing portion 13, but the dimension may be adjusted according to requirements for waterproofness of a practical product.

It should be noted that in another embodiment, the dome 11 may be integrally formed with the folded ring 12.

It can be seen from FIG. 1 and FIG. 3 that the above-described structure saves space in a thickness direction, increases a joint area, i.e., adhesive area, between the diaphragm 10 and the basket 3, thereby joint strength is improved and waterproofness of the product is improved.

Further, the magnetic circuit system 2 includes a magnetic bowl 21, a magnetic steel 22 assembled to the magnetic bowl 21 and a pole core 23 attached to the magnetic steel 22. The magnetic bowl 21 includes a bottom plate 211 opposite to the dome 11 and a side plate 212 extending from an edge of the bottom plate 211 towards the diaphragm 10. The magnetic steel 22 is fixed to the bottom plate 211. A magnetic gap is formed between the side plate 212 and the magnetic bowl 21. The voice coil 14 extends to the magnetic gap.

Further, the sound device further includes an elastic piece 4 elastically supporting the magnetic bowl 21 and the lower surface of the basket 3, and one end of the elastic piece 4 is connected to the side plate 212, while the other end of the elastic piece 4 is fixed to the lower surface.

Further, a support column 34 is formed by extending from the lower surface 33 of the basket 3 to be away from the upper surface 32. The sound device further includes a conductive terminal 5 assembled to the support column 34. One end of the conductive terminal 5 is electrically connected to the voice coil 14, while the other end is electrically connected to an external power supply. The sound device further includes a bottom cover 6 fixed to the support column 34, and the bottom cover 6 is disposed separately from the elastic piece 4.

Compared with the existing technology, with respect to the present disclosure, a joint area, i.e., adhesive area, between the diaphragm 10 and the basket 3 is increased by fixing the fixing portion 13 of the diaphragm 10 to the outer side surface 31 and the upper surface 32 of the basket 3 through adhesive, and a sealing ring is formed. Therefore, stability of the entire structure, and waterproofness and acoustical performance of the product are improved.

It should be noted that various changes and modifications may be made by those skilled in the art without departing from the spirit and scope of the present disclosure.

What is claimed is:

1. A sound device, comprising a vibration system, a magnetic circuit system, and a basket that accommodates the vibration system and the magnetic circuit system, wherein the vibration system comprises a diaphragm and a voice coil that drives the diaphragm to vibrate, and the diaphragm comprises a dome, a folded ring surrounding the dome and a fixing portion extending from an edge of the folded ring and fixed to the basket, wherein the basket comprises an upper surface opposite to the dome, a lower surface opposite to the upper surface, and an outer side surface connecting the upper surface and the lower surface, the fixing portion comprises a first fixing portion fixed to the upper surface and extending to an edge of the upper surface and a second fixing portion extending from the first fixing portion and along the outer side surface, the second fixing portion in a continuous ring shape is around an end of the outer side surface close to the upper surface, and a thickness of the second fixing portion is increasing in a direction away from the upper surface;

wherein the folded ring comprises a joint portion joining the dome and a protrusion extending from the joint portion, an end of the protrusion away from the joint portion is connected with the fixing portion, and the protrusion protrudes in a direction away from the voice coil.

2. The sound device according to claim 1, wherein the diaphragm is a silica gel membrane, and the diaphragm and the basket are integrally injection-molded.

3. The sound device according to claim 1, wherein the joint portion is provided with a through hole, and the dome covers the through hole and extends to an end of the joint portion close to the protrusion.

4. The sound device according to claim 1, wherein the basket is in a rectangular ring shape.

5. The sound device according to claim 4, wherein the magnetic circuit system comprises a magnetic bowl, a magnetic steel assembled to the magnetic bowl and a pole core attached to the magnetic steel, the magnetic bowl comprises a bottom plate opposite to the dome and a side plate extending from an edge of the bottom plate towards the diaphragm, and the magnetic steel is fixed to the bottom plate, wherein a magnetic gap is formed between the side plate and the magnetic steel, and the voice coil extends to the magnetic gap.

6. The sound device according to claim 5, wherein the sound device further comprises an elastic piece elastically supporting the magnetic bowl and the lower surface of the basket, and one end of the elastic piece is connected to the side plate, while the other end of the elastic piece is fixed to the lower surface.

7. The sound device according to claim 6, wherein a support column is formed by extending the lower surface of the basket to be away from the upper surface, the sound device further comprises a conductive terminal assembled to the support column, and one end of the conductive terminal is electrically connected to the voice coil, while the other end is electrically connected to an external power supply.

8. The sound device according to claim 7, wherein the sound device further comprises a bottom cover fixed to the support column, and the bottom cover is disposed separately from the elastic piece.

9. The sound device according to claim 1, wherein the second fixing portion is sealed with the outer side surface.

* * * * *